US005705899A

United States Patent [19]

Penninga et al.

[11] Patent Number: 5,705,899

[45] Date of Patent: Jan. 6, 1998

[54] CRT DISPLAY HAVING COMPENSATION FOR IMAGE ROTATION AND CONVERGENCE ERRORS

[75] Inventors: Johannes Penninga; Jacobus H. T. Jamar, both of Eindhoven, Netherlands

[73] Assignee: U.S. Philips Corporation, New York, N.Y.

[21] Appl. No.: 354,568

[22] Filed: Dec. 13, 1994

[30] Foreign Application Priority Data

Dec. 24, 1993 [BE] Belgium ..... 09301457

[51] Int. Cl.[6] ..... G09G 1/28; G09G 1/04; H01J 29/06; H01J 1/52

[52] U.S. Cl. ..... 315/368.26; 315/8; 315/85; 315/370; 315/399

[58] Field of Search ..... 315/370, 371, 315/399, 8, 85, 368.25, 368.26

[56] References Cited

U.S. PATENT DOCUMENTS

| | | | |
|---|---|---|---|
| 4,899,082 | 2/1990 | Sands et al. | 315/8 |
| 5,157,305 | 10/1992 | Satoh et al. | 315/370 |
| 5,367,221 | 11/1994 | Santy et al. | 315/8 |

FOREIGN PATENT DOCUMENTS

| | | | |
|---|---|---|---|
| 1302598 | 6/1992 | Canada | G09G 1/00 |

*Primary Examiner*—Gregory C. Issing
*Attorney, Agent, or Firm*—Robert J. Kraus

[57] ABSTRACT

A color display device comprising a cathode ray tube and a deflection unit also includes a compensation coil or a compensation-coil system, for example, on the outside of the yoke of the deflection unit, so as to compensate for frame errors and convergence errors caused by the earth's magnetic field.

13 Claims, 4 Drawing Sheets

CRT DISPLAY HAVING COMPENSATION FOR IMAGE ROTATION AND CONVERGENCE ERRORS

BACKGROUND OF THE INVENTION

This invention relates to a colour display device comprising a cathode ray tube, a means for generating three electron beams, a display screen and a deflection unit for generating deflection fields for deflecting electron beams across the display screen, and means for compensating for image rotation.

The invention also relates to a deflection unit for a cathode ray tube.

A display device of the type mentioned in the opening paragraph and a deflection unit of the type mentioned in the second paragraph are known from Canadian Patent Specification CA 1,302,598. The earth's magnetic field causes a rotation of the image displayed (this effect is commonly referred to as image rotation or frame rotation). The known display device comprises a coil which compensates for image rotation.

However, it has been found that the earth's magnetic field does not only cause a frame rotation but also convergence errors. Convergence errors adversely affect the quality of the image displayed. The known means do not or hardly compensate for convergence errors.

SUMMARY OF THE INVENTION

It is an object of the invention to provide a display device having an improved quality of the displayed image.

To this end, in accordance with an aspect of the invention, the display device in accordance with the invention is characterized in that the deflection unit comprises a yoke and the means for compensating for image rotation comprise a coil which is situated on the outside of said yoke.

A coil which is arranged in such a position is capable of compensating for the negative effect of the earth's magnetic field on the frame rotation as well as the negative effect of the earth's magnetic field on the convergence of the electron beams. The compensation coil is arranged on the outside of the yoke. Surprisingly, it has been found that the yoke has a positive effect on the magnetic field generated by the compensation coil.

The coil is preferably situated between the centre of the yoke and the side of the yoke facing the display screen. In this area an optimum ratio between image-rotation compensation and convergence compensation can be attained.

A display device in accordance with a second aspect of the invention is characterized in that the means for compensating for image rotation are provided with a compensation coil or compensation-coil system for generating a compensation field with an axial component. In operation, said compensation coil or compensation-coil system generates an effect on the frame rotation as well as on the convergence, and said compensation coil or compensation-coil system is arranged and/or is energizable in a manner such that the ratio rotation effect/convergence effect generated by the compensation coil is at least substantially equal to the ratio rotation effect/convergence effect generated by the earth's magnetic effect.

BRIEF DESCRIPTION OF THE DRAWINGS

These and further aspects of the invention will be explained in greater detail by way of example and with reference to the accompanying drawings, in which.

The Figures are not drawn to scale. In general, like reference numerals refer to like parts.

DESCRIPTION OF THE PREFERRED EMBODIMENTS

Figure 1:
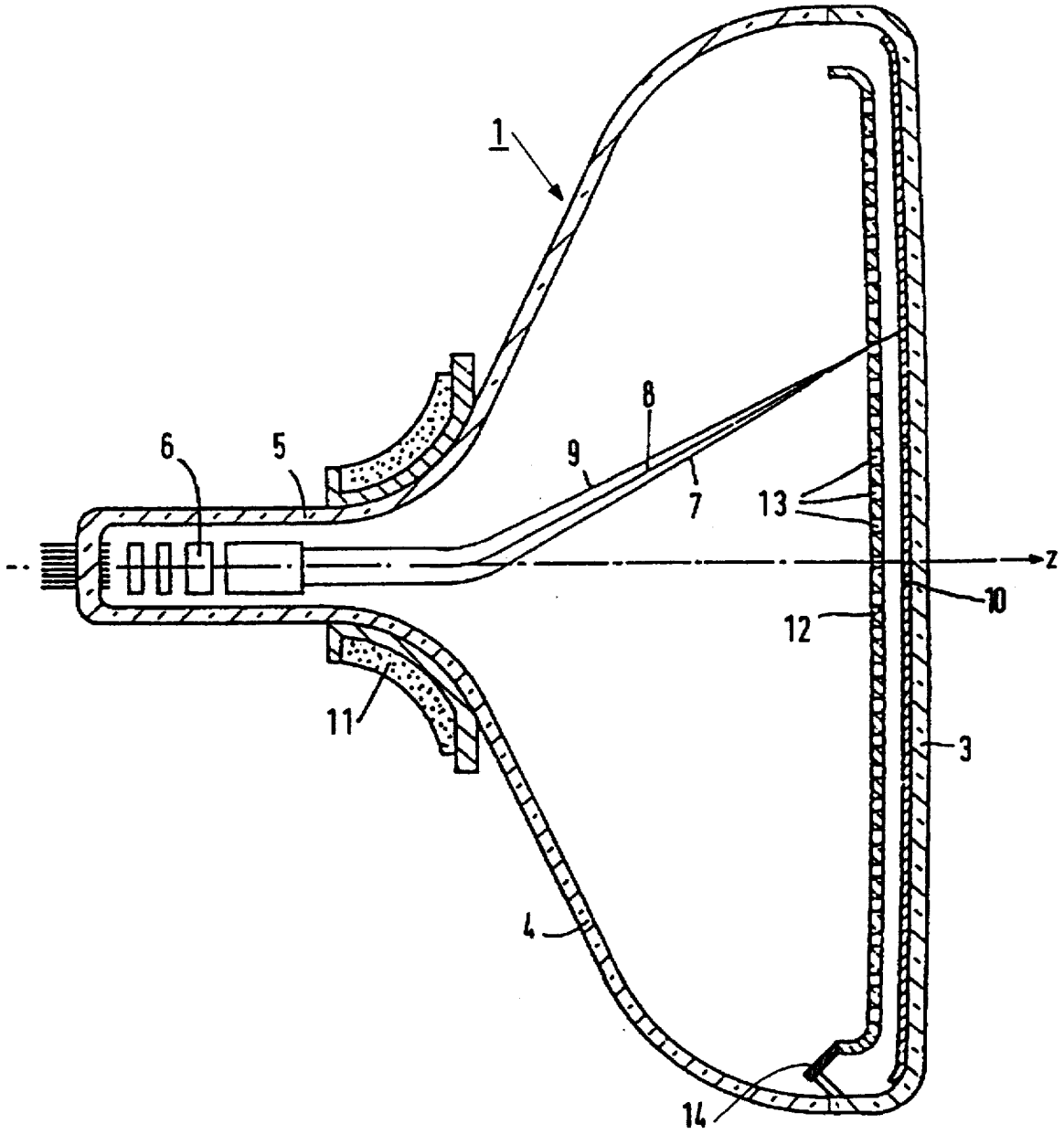
FIG. 1 is a display device.

A colour display device 1 (FIG. 1) includes an evacuated envelope 2 comprising a display window 3, a cone portion 4 and a neck 5. In said neck 5 there is provided an electron gun 6 for generating three electron beams 7, 8 and 9. A display screen 10 is present on the inside of the display window. The display screen 10 comprises a phosphor pattern of phosphor elements luminescing in red, green and blue. On their way to the display screen the electron beams 7, 8 and 9 are deflected across the display screen 10 by means of a deflection unit 11 and pass through a shadow mask 12 which is arranged in front of the display window 3 and which comprises a thin plate having apertures 13. The shadow mask is suspended in the display window by means of suspension means 14. The three electron beams converge and pass through the apertures of the shadow mask at a small angle with respect to each other and, consequently, each electron beam impinges on phosphor elements of only one colour.

The earth's magnetic field disturbs the image displayed on the display screen 10. The axial component of the earth's magnetic field causes a rotation of the image displayed (frame rotation). In addition, the earth's magnetic field adversely affects the convergence of the three beams. Well-known coils compensate for the rotation error but do not or hardly compensate, for the convergence error. Within the scope of the invention it has been recognized that the earth's magnetic field causes convergence errors and that both frame rotation and convergence errors caused by the earth'magnetic field can be compensated for by means of a coil or coil system.

Figure 2:
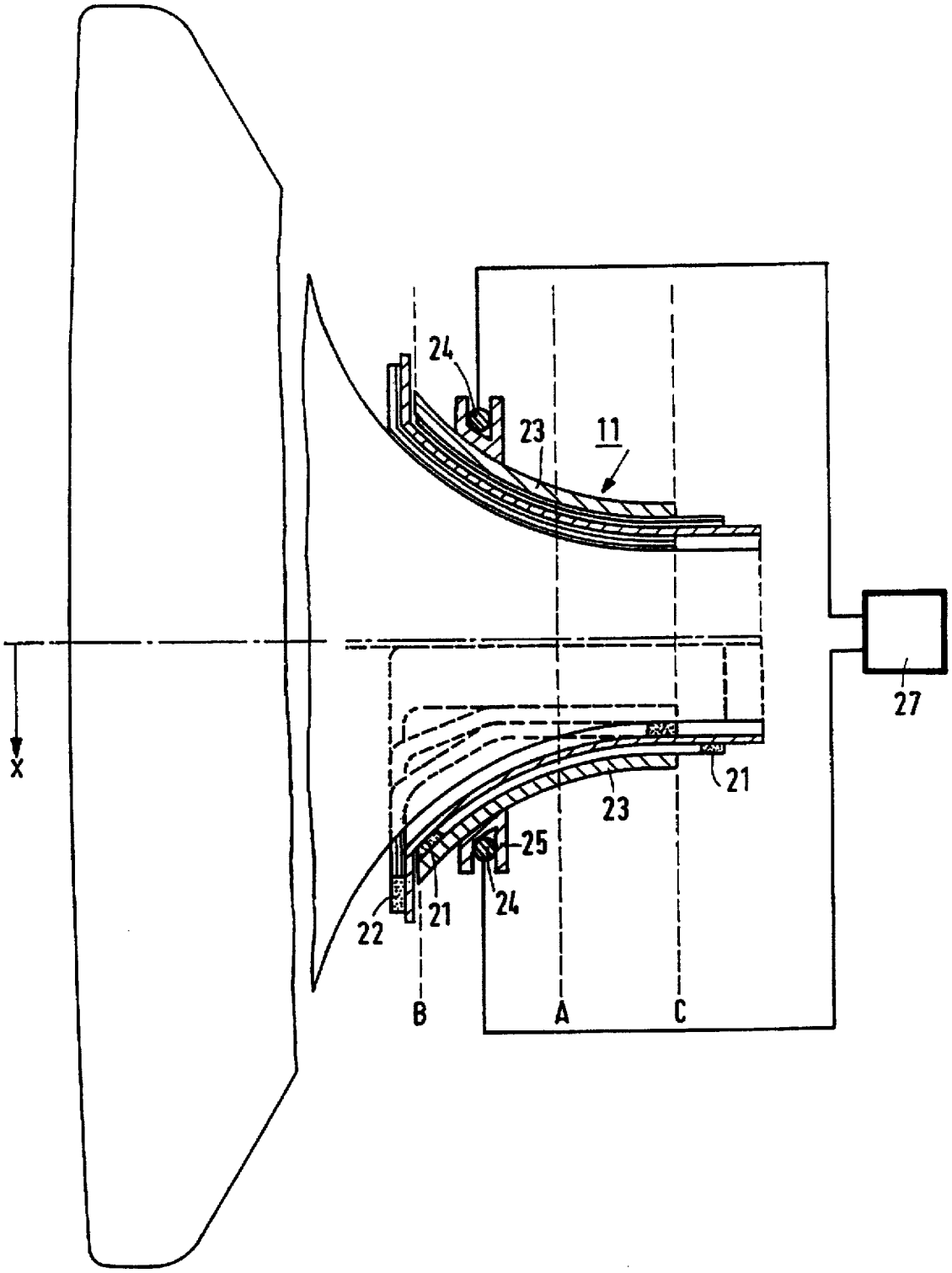
FIG. 2 is a sectional view of a deflection unit comprising a compensation coil.

FIG. 2 is a sectional view of a deflection unit in accordance with the invention. Said deflection unit comprises two deflection coil systems 21 and 22 for deflecting the electron beams in two mutually perpendicular directions (x and y direction). In this example, the deflection unit further comprises a yoke 23. Said yoke is made of soft-magnetic material. A compensation coil 24 is situated on the outside of said yoke. Surprisingly, it has been found that the yoke has a very limited, yet positive, effect on the magnetic field generated by the compensation coil. In general, it holds that the effect produced on the convergence is greater as the compensation coil is arranged further towards the rear (i.e. in the direction of the electron gun). The compensation coil 24 is preferably positioned between plane A and plane B. Plane A extends through the centre of the yoke and plane B substantially coincides with the end 25 of the yoke facing the display screen. Plane A is equidistant from the planes B and C, plane C substantially coinciding with the end of the yoke facing the electron gun. The expression "on the outside of" is to be understood to mean within the scope of the invention, a position between the planes C and B. In this example, compensation coil 24 is fitted into a holder 25.

It will be obvious that many variations are possible within the scope of the invention.

A preferred embodiment is, for example, formed by a display device comprising means for adjusting the position of the coil relative to the yoke. The coil may for example be fitted into a holder whose position can be adjusted. In particular, the adjustment in the axial direction (z direction) is important. By virtue thereof, the compensation coil(s) can be adjusted so that the optimum position is obtained. However, the compensation coil(s) may alternatively be secured directly on the yoke. To this end, the yoke may comprise securing means (for example, hooks). This is a simple construction.

Figure 3:
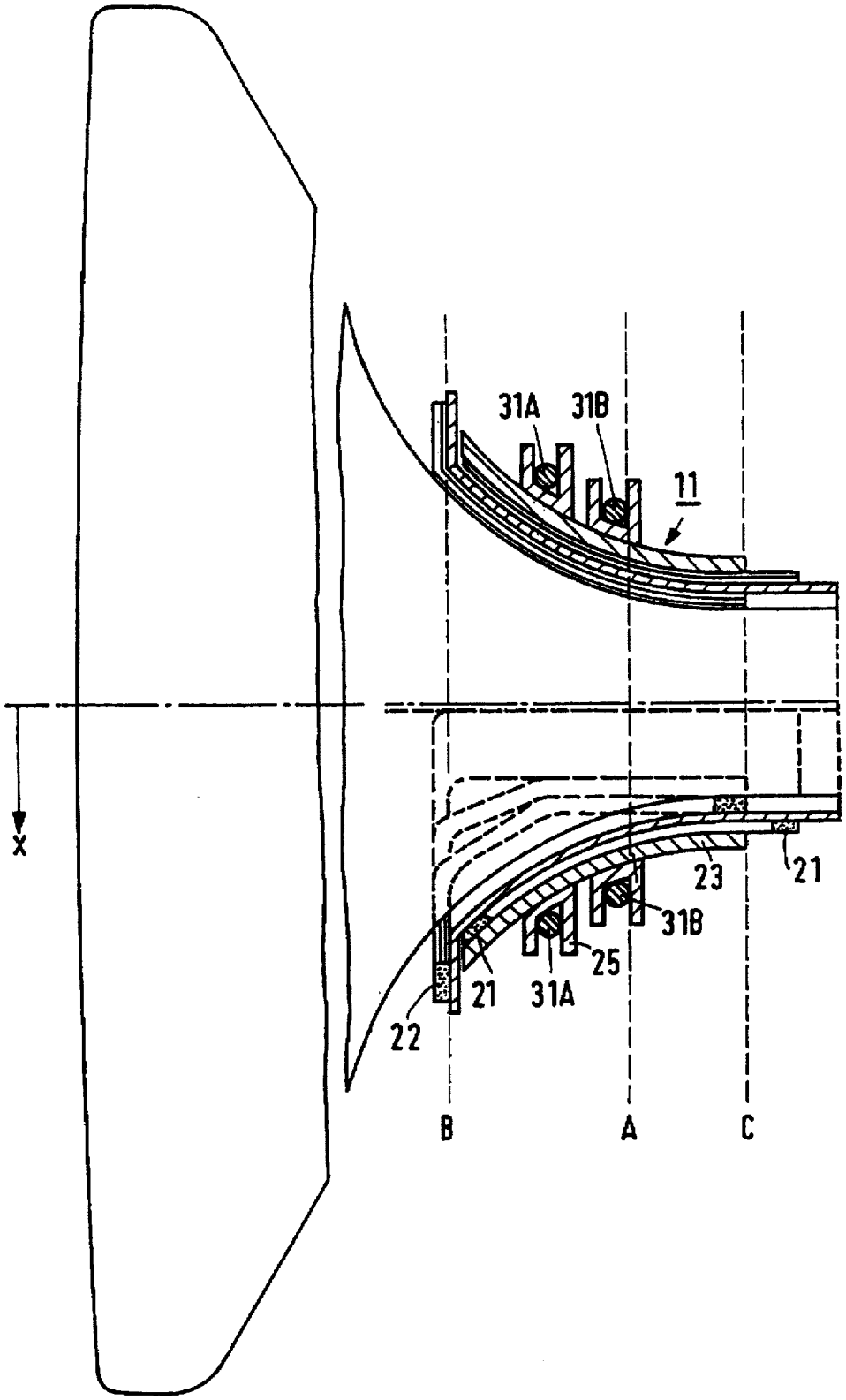
FIG. 3 shows a deflection unit which comprises a compensation coil consisting of two sub-coils.

In its simplest form, the compensation coil is ring-shaped, the axial axis of the coil at least substantially coinciding with the axial axis of the yoke. However, the invention is not limited thereto. The coil may be composed of two or more sub-coils. FIG. 3 shows such an embodiment. The display device comprises a compensation coil 31 including two sub-coils 31*a* and 31*b* having different axial positions. By virtue thereof, the magnetic field generated by the compensation coil can be further optimized. In addition, by separately adjusting the intensity of the current passing through the sub-coils, an effect can be brought about which is comparable to the effect which would be produced if the position of the coil were adjustable. For example, if a current is passed only through coil 31*a* or 31*b*, the "position" of the compensation coil corresponds to the position of sub-coil 31*a* or 31*b*, respectively. In other words, the "position" of the compensating field is made electronically adjustable, i.e. by adjusting the current intensities in the sub-coils. It is even possible to transfer the compensating field to a position beyond the sub-coils by providing opposite currents through the sub-coils.

Figure 4A:
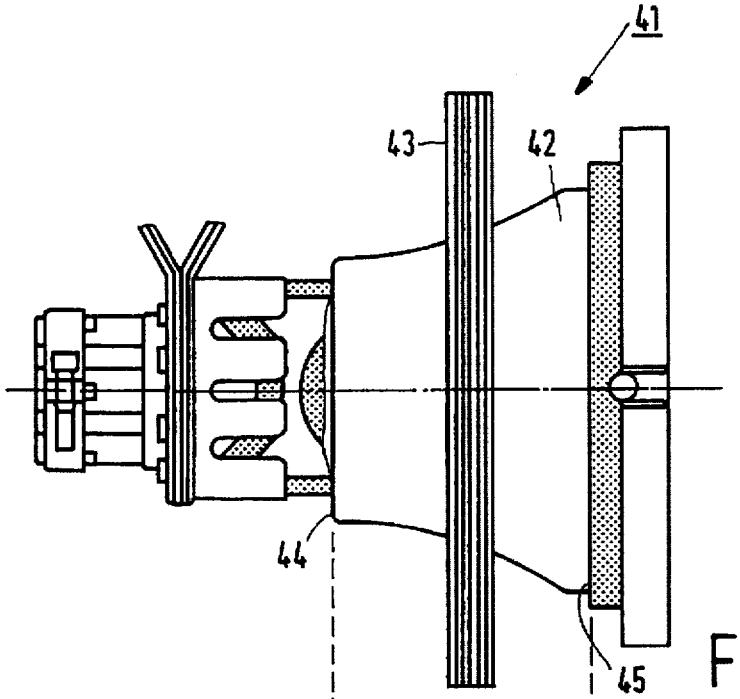
FIG. 4A is an elevational view of a deflection unit 41 comprising a yoke 42 which is surrounded by a compensation coil 43.
Figure 4B:
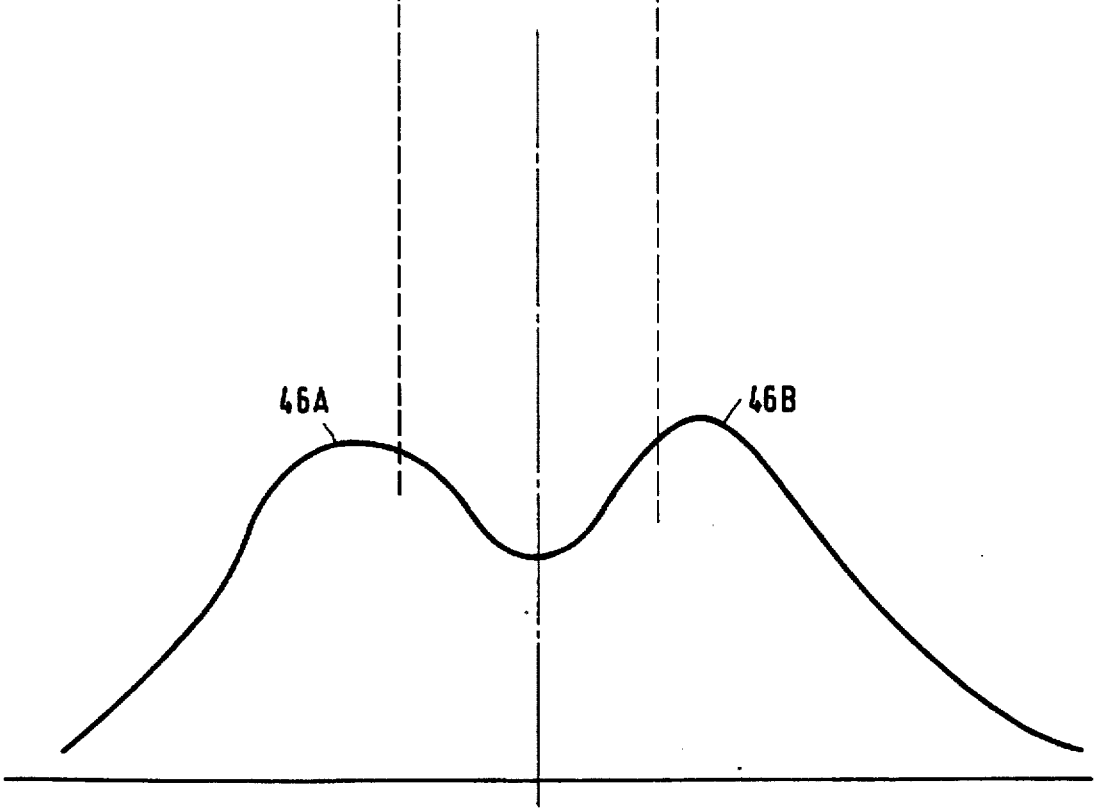
FIG. 4B shows the magnetic field generated by the compensation coil.

FIGS. 4A and 4B illustrate the unexpected effect of the yoke-compensation coil combination.

FIG. 4A is an elevational view of a deflection unit 41 comprising a yoke 42 which is surrounded by a compensation coil 43.

FIG. 4B shows the magnetic field 46, generated by the compensation coil, at the location of the electron beams.

The yoke weakens the field generated by compensation coil 43 at the location of said coil. On a first impression, the conclusion could thus be drawn that the indicated position of the compensation coil is very unfavourable because the yoke screens the electron beams from the action of the compensation coil. Surprisingly, however, the yoke does not only slightly weaken the generated field at the location of the coil, but conducts it away to the two end portions of the yoke, so that the generated magnetic field does not exhibit a maximum at the location of the coil, but at both end portions and at a small distance from the said two end portions 44 and 45 of the yoke. Thus, the effect of the compensating field as a whole is surprisingly hardly, or not at all, weakened by the yoke, but is spread and can be regarded as the combined effect of two magnetic fields. Magnetic field 46A predominantly influences the electron beams before they are deflected, thereby compensating in particular for the effect of the disturbing magnetic field on undetected electron beams, while magnetic field 46B predominantly influences the electron beams after they have been deflected, thereby compensating in particular for the effect of the disturbing magnetic field on deflected electron beams.

Consequently, the action of the yoke-compensation coil combination can be compared to that of a deflection unit having two different coils which are situated approximately at the position of the maximaof fields 46A and 46B. The combined effects of the fields 46A and 46B allows both the rotation and the convergence errors generated by the earth's magnetic field to be effectively compensated. The effect shown in FIG. 4B, i.e. the division of the field into two fields 46A and 46B, can be attributed to the fact that the compensation coil is situated on the outside of the yoke (that is, between plane B and plane C).

The display device preferably comprises means for applying an adjustable voltage to the compensation coil or, if the compensation coil includes a plurality of sub-coils, for applying adjustable voltages to said sub-coils. By virtue thereof, the compensating effect of the coil can be adapted to the prevailing earth's magnetic field. FIG. 2 diagrammatically shows that the compensation coil is connected to means 27 for adjusting the voltage across and hence the current through the compensation coil.

Table I gives the effect of a change in the magnitude of the axial component of the earth's magnetic field of 0.06 mT on the frame and the convergence. Rotation B/C relates to the deviation in the y-(vertical) direction of the frame at the points B (one end of the horizontal axis of the screen) and C (end of the horizontal axis situated opposite B). Since the values of the ends are of opposite sign they are given as ±. The deviation is given in mm. BRy in A relates to the deviation (in mm) between the outermost electron beams (R=Red, B=Blue) in the centre of the display screen (=point A), measured in the y-(vertical) direction, BRy in B/C relates to the deviation between the outermost beams at the points B and C as defined hereinabove. Both effects (rotation B/C and BRy) have a negative effect on the image displayed. These effects are compensated for by means of the compensation coil(s) in accordance with the invention.

| type of tube | 21" | 66FS | 28WS | 32WS | 36WS |
|---|---|---|---|---|---|
| aspect ratio | (4:3) | (4:3) | (16:9) | (16:9) | (16:9) |
| deflection angle | 90° | 110° | 110° | 110° | 110° |
| rotation B/C | −/+1.75 | −/+3.7 | −/+4.2 | −/+4.9 | −/+6.25 |
| BRy in A | 0.44 | 0.36 | 0.34 | 0.37 | 0.45 |
| BRy in B/C | 0.45 | 0.32 | 0.30 | 0.30 | 0.37 |
| screen width | 41 cm | 53 cm | 58 cm | 66 cm | 75 cm |

A display device in accordance with a second aspect of the invention is characterized in that the means for compensating for image rotation are provided with a compensation coil or compensation-coil system for generating a compensation field with an axial component, in operation, said compensation coil or compensation-coil system generating an effect on the frame rotation as well as on the convergence, and said compensation coil or compensation-coil system being arranged and/or energizable in a manner such that the ratio rotation effect/convergence effect generated by the compensation coil is at least substantially equal to the ratio rotation effect/convergence effect generated by the earth's magnetic effect.

The expression "at least substantially equal" is to be understood to mean within the scope of the invention that said ratios are equal, or, if there is a difference, the difference is relatively small, i.e., the difference between said ratios is maximally a factor of approximately 0.75 to 1.25 and, preferably, differ by less than 10%. If this condition is met, both the frame rotation caused by the earth's magnetic field and the convergence errors caused by the earth's magnetic field can be largely or almost completely compensated for by means of the compensation coil(s). Said ratios are measured at the ends of the horizontal axis.

Such a display device comprising such a compensation coil or compensation-coil system can be manufactured, for example, as follows:

- a display device without a compensation coil or compensation-coil system is placed in the earth's magnetic field or a display device is placed in an axial magnetic field which imitates the axial component of the earth's magnetic field (it will of course be obvious to those skilled in the art that the condition "without a compensation coil or compensation-coil system" is also met if the display device comprises a compensation coil or compensation-coil system which is not energized and hence does not generate a field),
- the frame rotation is measured at the points B and C (end of the horizontal axis),
- BRy is measured at the points B and C,
- the display device is placed in a field-free space and the frame rotation and BRy are measured again,
- the difference represents the frame rotation and the BRy caused by the axial component of the earth's magnetic field, the ratio of these numbers can now be calculated and depends, in a first-order approximation, on the strength of the earth's magnetic field,
- the display device is provided with an energizable compensation coil or compensation-coil system and placed in a field-free space (i.e. without a magnetic field or at least without an axial magnetic field), the compensation coil being energized so that a compensation field is generated,
- the frame rotation and the BRy are measured at the indicated points and the ratio is calculated. In this manner, the frame rotation/BRy ratio for the compensation coil or coils is obtained. The two ratios found are compared. It has been recognized within the scope of the invention that the ratio for the compensation coil(s) can be influenced, inter alia, by the position of the coil(s) and/or the currents passing through the sub-coils, i.e. by the manner in which the coil or the coil system is arranged and/or energizable. Subsequently, if necessary, the position of the compensation coil or compensation-coil system, or the distinguishable currents passing through different sub-coils of the compensation-coil system are varied until the measured frame rotation/convergence ratio for the compensation coil(s) corresponds at least substantially to the measured ratio for the earth's magnetic field. The above procedure can be partly or completely simulated and calculated by means of a computer program.

It will be obvious to those skilled in the art that by following substantially the same procedure, but in reverse, it can readily be established whether a display device complies with this aspect of the invention.

The position of the compensation coil(s) mentioned on the preceding pages (on the outside of the yoke, i.e. between the planes B and C) is a preferred position which provides the possibility of substantially satisfying the desired ratio by means of a simple and compact construction. It has been found that this construction is very suitable for, in particular, a 90° cathode ray tube. In addition, the required current intensities (and hence the energy required) for the compensation coil(s) are relatively low. Besides, in applications in which a plurality of sub-coils are used further refinements to the compensation field can be generated. By virtue thereof, a further improved picture quality can be provided. In the case of a simple coil, as shown in FIG. 2, which is arranged between plane B and plane A at a distance of approximately 15 mm from plane B, the distance between plane B and plane C being approximately 50 mm, it has been found that for a 21" 90° CRT comprising a yoke, the frame rotation/BRy ratio is approximately equal to 3.7. From Table I it follows that if such a cathode ray tube is exposed to the earth's magnetic field said ratio is 1.5 mm 0.45 mm=3.88. Consequently, the frame rotation/BRy ratios are substantially identical for the earth's magnetic field and the compensation coil. An identical coil which is placed in plane B (see FIG. 2) has a frame rotation/BRy ratio which is equal to 5. The ratio of an identical coil which is placed in plane A (see FIG. 2) is approximately equal to 3. Consequently, if the coil is placed between the planes B and A, the frame rotation caused by the earth's magnetic field can be compensated for and, in addition, the convergence error (BRy) can be largely, i.e. at least 75%, compensated for. For comparison, it is noted that an identical coil which is arranged 20 mm in front of plane B has a frame rotation/BRy ratio of approximately 9, which means that if the frame rotation caused by the earth's magnetic field is compensated for by the compensation coil, less than 40% of the convergence error is compensated for.

It will be obvious that within the scope of the invention many variations are possible. For example, one or more sub-coils may be situated outside the area indicated by the planes B and C. The term "earth's magnetic field" is to be understood to mean herein constant magnetic fields.

We claim:

1. A colour display device comprising: a cathode ray tube including means for generating three electron beams, a display screen and a deflection unit for generating deflection fields for deflecting the electron beams across the display screen, wherein the deflection unit comprises a yoke made of a soft magnetic material and centered around an axis, and means for compensating for image rotation due to an external magnetic field and which comprise compensation coil means substantially perpendicular to the axis and which surrounds the yoke and is situated in an axial direction between first and second planes which coincide with a first end of the yoke facing the display screen and second end of the yoke opposite said first end, respectively, such that, in operation, a magnetic field generated by the compensation coil means has first and second maxima at a short distance from said first and second ends of the yoke, respectively.

2. A colour display device as claimed in claim 1, wherein the compensation coil means is situated between the centre of the yoke and the first end of the yoke facing the display screen.

3. A colour display device as claimed in claims 1 or 2, which further comprises means for adjusting the position of the compensation coil means relative to the yoke.

4. A colour display device as claimed in claim 3, wherein the compensation coil means comprise a compensation coil fitted into a holder whose position can be adjusted.

5. A colour display device as claimed in claims 1 or 2 wherein the compensation coil means comprises at least two sub-coils having different axial positions.

6. A colour display device as claimed in claims 1 or 2 wherein the display device comprises means for applying an adjustable voltage to the compensation coil means.

7. A colour display device as claimed in claim 5, wherein the display device comprises means for applying adjustable voltages to the at least two sub-coils.

8. A colour display device comprising: a cathode ray tube including means for generating three electron beams, a display screen and a deflection unit, including a yoke made of a soft magnetic material, for generating deflection fields for deflecting the electron beams across the display screen, and means for compensating for image rotation and convergence errors comprising compensation coil means, situated on and surrounding the yoke between axial ends of the yoke, for generating a compensation field with at least an axial component, said compensation coil means producing an effect on the frame rotation as well as on the convergence and being positioned and/or energizable in a manner such that the ratio rotation effect/convergence effect produced by the compensation coil means is at least substantially equal to the ratio rotation effect/convergence effect produced by the earth's magnetic field.

9. A cathode ray tube display device comprising:

an electron gun for generating at least one electron beam, a display screen, a deflection unit including winding means for generating magnetic deflection fields for deflecting the electron beam across the display screen, and a magnetic yoke made of a soft magnetic material, and means for compensating image rotation and convergence errors caused by a magnetic field external of the cathode ray tube and which comprises compensation coil means positioned on the outside of and surrounding the magnetic yoke and located between first and second ends of the magnetic yoke, the compensation coil means comprising at least first and second coils axially spaced apart along the outside of the magnetic yoke.

10. The cathode ray tube display device as claimed in claim 9 further comprising means for individually adjusting respective current levels in the first and second coils.

11. A cathode ray tube display device comprising:

an electron gun for generating first, second and third electron beams, a display screen, a deflection unit including winding means for generating magnetic deflection fields for deflecting the electron beam across the display screen, and a magnetic yoke made of a soft magnetic material, and means for compensating image rotation and convergence errors caused by a magnetic field external of the cathode ray tube and which comprises compensation coil means positioned on the outside of and surrounding the magnetic yoke and located between first and second ends of the magnetic yoke, the compensation coil means generating magnetic compensation field with an axial magnetic field component such that the ratio of rotation effect/convergence effect produced thereby is substantially equal to the ratio of the rotation effect/convergence effect produced by the earth's magnetic field.

12. The cathode ray tube display device as claimed in claim 11 wherein the difference between said ratios lies in the range of 0.75 to 1.25.

13. A cathode ray tube display device comprising:

an electron gun for generating at least one electron beam, display screen, a deflection unit including winding means for generating magnetic deflection fields for deflecting the electron beam across the display screen and a magnetic yoke made of a soft magnetic material, and means for compensating image rotation and convergence errors caused by a magnetic field external of the cathode ray tube and which comprises compensation coil means positioned on the outside of and surrounding the magnetic yoke and located between first and second ends of the magnetic yoke, the compensation coil means comprising a coil positioned in a holder that is axially adjustable along the outside of the magnetic yoke.

* * * * *

UNITED STATES PATENT AND TRADEMARK OFFICE

CERTIFICATE OF CORRECTION

PATENT NO. : 5,705,899 
DATED : January 6, 1998
INVENTOR(S) : Johannes Pennings and Jacobus H.T. Jamar It is certified that error appears in the above-identified patent and that said Letters Patent is hereby corrected as shown below:

Title page,
Item [54], Title, after "DISPLAY" insert -- DEVICE --.

Column 8,
Line 10, after "generating" insert -- a --.
Line 22, before "display" insert -- a --.

Signed and Sealed this

Twelfth Day of November, 2002

*Attest:*

*Attesting Officer*

JAMES E. ROGAN
*Director of the United States Patent and Trademark Office*